US011814994B2

(12) United States Patent
Baur

(10) Patent No.: US 11,814,994 B2
(45) Date of Patent: Nov. 14, 2023

(54) COMPONENT OF AN EXHAUST SYSTEM AND METHOD FOR MANUFACTURING SUCH A COMPONENT

(71) Applicant: Faurecia Emissions Control Technologies, Germany GmbH, Augsburg (DE)

(72) Inventor: Marco Baur, Augsburg (DE)

(73) Assignee: Faurecia Emissions Control Technologies, Germany GmbH

( * ) Notice: Subject to any disclaimer, the term of this patent is extended or adjusted under 35 U.S.C. 154(b) by 286 days.

(21) Appl. No.: 17/274,464

(22) PCT Filed: Sep. 9, 2019

(86) PCT No.: PCT/EP2019/073968
§ 371 (c)(1),
(2) Date: Nov. 12, 2021

(87) PCT Pub. No.: WO2020/053135
PCT Pub. Date: Mar. 19, 2020

(65) Prior Publication Data

US 2023/0137759 A1 May 4, 2023

(30) Foreign Application Priority Data

Sep. 10, 2018 (DE) ..... 102018122042.1

(51) Int. Cl.
*F01N 13/18* (2010.01)
*F01N 1/08* (2006.01)
*F01N 13/08* (2010.01)

(52) U.S. Cl.
CPC ..... *F01N 1/082* (2013.01); *F01N 13/08* (2013.01); *F01N 13/185* (2013.01);
(Continued)

(58) Field of Classification Search
CPC ..... F01N 1/082; F01N 3/06; F01N 2230/06
See application file for complete search history.

(56) References Cited

U.S. PATENT DOCUMENTS 3,643,759 A * 2/1972 Bailey ..... F01N 1/165 181/278
3,677,364 A * 7/1972 Pawlina ..... F01N 13/1855 181/269

(Continued)

FOREIGN PATENT DOCUMENTS

DE 102008060526 A1 9/2009
DE 102015113159 A1 2/2017

*Primary Examiner* — Jonathan R Matthias
(74) *Attorney, Agent, or Firm* — Carlson, Gaskey & Olds, P.C.

(57) ABSTRACT

A component of an exhaust system for an internal combustion engine comprises a wall in which at least one opening is provided. A perforated cover at least partly closes the at least one opening. The perforated cover is mounted on the wall using a holder, and a portion of the perforated cover engages into an opening provided on the holder. There is also presented an exhaust system comprising such a component, and a method for manufacturing such a component, in which the perforated cover is mounted on the holder by introducing at least one portion of the perforated cover into an opening provided on the holder.

18 Claims, 6 Drawing Sheets

(52) U.S. Cl.
CPC ..... *F01N 13/1811* (2013.01); *F01N 13/1872* (2013.01); *F01N 2470/04* (2013.01)

(56) References Cited

U.S. PATENT DOCUMENTS

| | | | | |
|---|---|---|---|---|
| 5,177,962 | A * | 1/1993 | Hall | F01N 13/002 96/380 |
| 5,451,728 | A * | 9/1995 | Chandler | F01N 13/002 181/231 |
| 5,866,859 | A * | 2/1999 | Karlsson | F02B 63/02 181/231 |
| 2002/0081966 | A1 | 6/2002 | Achen | |
| 2007/0221441 | A1* | 9/2007 | Edholm | F01N 3/06 181/231 |
| 2008/0035421 | A1* | 2/2008 | Feist | F01N 13/002 181/212 |
| 2009/0084626 | A1* | 4/2009 | Miyazawa | F01N 1/00 181/226 |
| 2016/0312852 | A1 | 10/2016 | Herald et al. | |
| 2017/0044965 | A1* | 2/2017 | Wasif | F01N 13/16 |
| 2017/0145881 | A1 | 5/2017 | Abram | |
| 2018/0252292 | A1 | 9/2018 | Herald et al. | |

* cited by examiner

COMPONENT OF AN EXHAUST SYSTEM AND METHOD FOR MANUFACTURING SUCH A COMPONENT

CROSS-REFERENCE TO RELATED APPLICATIONS

This application is the US national phase of PCT/EP2019/073968 which was filed on Sep. 9, 2019.

FIELD OF THE DISCLOSURE

This disclosure relates to a component of an exhaust system for an internal combustion engine, comprising a wall in which at least one opening is provided and a perforated cover which at least partly closes the opening.

This disclosure also relates to an exhaust system for an internal combustion engine comprising such a component and to a method for manufacturing such a component.

BACKGROUND

The component of an exhaust system can be an exhaust-gas-carrying pipe or an exhaust-gas-carrying housing, in which for example a catalyst substrate or a particle filter is arranged. The exhaust-gas-carrying housing can also be a muffler housing.

The internal combustion engine in particular is an engine for a motor vehicle which operates according to the Otto principle or according to the diesel principle.

Examples for components of the type mentioned above are to be found in DE 10 2015 113 159 A1. The opening covered by the perforated cover in the wall of the component serves to attenuate sound when the component is traversed by exhaust gas. Due to the (albeit low) throughput of gas through the perforation of the cover, less resonances are produced by standing waves within the component. In addition, turbulent flows in the exhaust gas flow can be attenuated and converted into laminar flows, which reduces the proportion of high frequencies in the frequency spectrum.

The perforated cover can be a metal sheet that is provided with a large number of small openings. The degree of perforation is in the order of 1% to not more than 10% of the total surface area of the cover, in particular in the range of 4% to 8%. Each individual pore has a surface area in the range between 0.02 $mm^2$ and 2 $mm^2$, preferably in the range of 0.04 $mm^2$ to 1 $mm^2$.

The perforated cover usually is welded to the wall of the exhaust-gas-carrying component. This results in a reliable attachment with the desired long service life. It has been found out, however, that under the occurring thermal expansions high loads can act on the perforated cover. The loads of the perforated cover turn out to be increasingly critical with increasing difference of the coefficient of thermal expansion of the components. Examples for different thermal expansions include ferritic steel alloys on the one hand, as they can be used for the exhaust-gas-carrying components, and austenitic steel alloys on the other hand, which are used for the perforated cover. Against this background, it is proposed in DE 10 2015 113 159 A1 to mount the perforated cover on the wall with a holder and by providing a clearance.

SUMMARY

The disclosure further seeks to improve known components of exhaust systems. In particular, these components should be quick and easy to manufacture and thereby inexpensive.

The disclosure provides a component as mentioned above, in which a holder is provided, by which the perforated cover is mounted on the wall of the component and a portion of the cover engages into an opening provided on the holder. Opening here is understood to be any local cavity or any local aperture on the holder. Preferably, however, the opening is a through opening, i.e. an aperture through a portion of the holder, that connects two opposite sides of the holder to each other. The engagement of the portion of the cover into the opening here means that the portion protrudes into the opening at least proceeding from a side. Optionally, the portion also can again protrude from the opening on an opposite side. Due to the engagement of the portion of the cover into the opening, the cover is fixed to the holder. Preferably, this is a form-locking fixation. There is obtained an assembly comprising the cover and the holder, which can be handled separately from the remaining parts of the component of an exhaust system. Due to the fact that the cover is connected to the holder, this assembly can be attached to the associated wall quickly and easily. Hence, this generally results in a quick and easy manufacturability of the component of the disclosure. It is also advantageous that the portion of the cover can be introduced into the associated opening on the holder quickly and in particular without any tools. The manufacture of the component of the disclosure thereby is further simplified and accelerated.

For the case that the portion also again protrudes out of the opening, the protruding part of the portion can be employed for a visual inspection of the correct position of the cover on the holder. Such an inspection can be effected by the human eye or in an automated way. In both variants, it is checked whether a part of the portion protrudes out of the opening. Additionally or alternatively, it can be checked how far the part of the portion protrudes out of the opening. With reference to these findings, a position of the cover on the holder is inferred.

In a preferred embodiment, the cover completely closes the opening. Hence, compared to a merely partly closed opening, relatively little exhaust gas can escape from the interior of the component of the disclosure via the opening. Nevertheless, the effects of sound attenuation already mentioned above are obtained.

The holder can be an embossed and/or stamped sheet metal component. Such components can be manufactured at low cost and in large numbers by using standard production facilities. Preferably, the holder has a wall thickness of 0.8 mm to 1.2 mm, in particular a wall thickness in the order of 1 mm. This range of wall thicknesses constitutes of a good compromise between an easy and inexpensive manufacturability of the holder and a sufficient mechanical stability of the same so that the cover can be reliably attached to the wall with the holder.

The cover advantageously has a wall thickness in an order of less than 1.0 mm, in particular a wall thickness in an order of less than 0.5 mm. It has been found out that this range of wall thicknesses represents a good compromise between the mechanically necessary stability of the cover and a good efficiency of the aforementioned acoustic effects.

Preferably, at least two portions of the cover each engage into separate openings on the holder, in particular wherein the at least two portions are arranged on substantially opposite sides of the cover. The number of portions of the cover, which engage into respectively associated openings on the holder, can be chosen freely in principle. There can also be provided three or four of such portions. It has been found out, however, that the cover can already be reliably attached to the holder with two portions. A particularly high reliability can be achieved when the two portions are arranged on substantially opposite sides of the cover and thus also engage into respectively associated openings provided on opposite sides of the holder. In this connection, the cover can be dimensioned in such a way that the two portions no longer can completely slip out of the associated openings due to a displacement of the cover relative to the holder. Hence, the cover is attached to the holder particularly securely.

According to one variant, at least one of the portions of the cover, which engages into an associated opening, is a corner of the cover and/or a tab of the cover, in particular wherein all portions of the cover, which engage into associated openings, are corners of the cover or tabs of the cover. A tab is understood to be a portion of the cover which proceeding from a global geometry of the cover, i.e. for example a square shape or a circular shape, protrudes from the same. The tab can also be referred to as a protrusion or lug. Such tabs can be manufactured comparatively easily. It is even easier when the portions of the cover are corners. The same do not produce any additional manufacturing expenditure.

The aforementioned tabs can, but need not, be provided at corners of the cover. In particular, the tabs are placed at edge portions of the cover, which each extend between two corners.

A particularly preferred embodiment is formed by two opposite corners of the cover engaging into respectively associated, mutually separate openings of the holder. The corners for example are diagonally opposite. Two adjacent corners of the cover also can engage into respectively associated, mutually separate openings of the holder.

Alternatively, one tab each can be provided on two opposite edges of the cover, wherein the two tabs engage into respectively associated, mutually separate openings of the frame.

Moreover, the holder can include a bearing portion that engages behind the cover in a direction perpendicular to the wall. Such a bearing portion can be configured as a lug, tongue, protrusion or nose on the holder. The rear grip fixes the cover in a direction perpendicular to the wall. In combination with the fact that a portion of the cover engages into an opening on the holder, a simple and reliable fixation of the cover to the holder is obtained. The holder is of structurally simple design so that it can be manufactured at low cost.

The holder and the cover can be coupled with each other non-cohesively and/or exclusively positively. Hence, cohesive connections can be omitted completely. In this connection, it is of course also possible to omit machines and facilities that are necessary for the production of cohesive connections. The manufacture of the component of the disclosure thereby is simplified. In particular, welding and soldering methods are omitted in this connection, which leads to the fact that related thermal loads of the components to be joined are eliminated. A reliable connection of the holder with the cover is ensured nevertheless, namely preferably via a positive coupling. The holder and the cover hence can be pre-mounted as an assembly. This simplifies and accelerates the associated manufacturing method.

In one embodiment, the holder is a frame that is mounted on the wall and surrounds the outer edge of the cover. In this way, the perforated cover is reliably attached to the component in all directions.

In an alternative, the cover is mounted on the holder substantially without clearance in a direction perpendicular to the wall. The cover hence in essence cannot move with respect to the holder perpendicularly to the wall. Thus, the cover reliably closes the opening of the wall. The clearance-free mounting in this direction does not exclude that the cover is movably mounted on the holder in other directions. Hence, the cover in particular is not pressed or clamped to the holder.

According to one variant, a clearance is provided between the holder and the cover so that the cover is shiftable parallel to the wall of the component. The perforated cover hence is attached to the component in such a way that heat-related expansions and resulting displacements relative to the holder and to the wall of the component are permitted. The perforated cover is mounted on the component with a kind of sliding fit.

For the case that the portion also again protrudes out of the opening, the aforementioned clearance and/or the aforementioned movability of the cover can be controlled in that a force is exerted on the protruding part of the portion either manually or mechanically and thus a displacement of the cover is accomplished. When the cover does not react to this force with a change in position, it possibly is jammed at the holder in an undesirable way.

The clearance can be formed between an end face of the cover and an abutment surface of the holder opposing the end face at a distance. Even if it is sufficient that the clearance is present on one side of the cover, a clearance ideally is present in each direction parallel to the wall in order to allow the expansion of the cover in each direction. Thus, the cover can expand or contract independently of the holder.

In this connection, the holder can include a mounting portion that is mounted on the wall, and a holding portion for the cover that is offset with respect to the mounting portion as seen in a direction perpendicular to the wall, wherein the abutment surface is formed by a step at the transition from the mounting portion to the holding portion. As a result, the holder can be single-layered and thus of structurally simple design. The mounting portion for example can be welded or soldered to the wall.

Advantageously, the opening or the openings is/are provided at the transition from the mounting portion to the holding portion, in particular wherein the opening or the openings is/are arranged in a corner region of the holder. As explained already, the opening or the openings is/are arranged on the holder in such a way that associated portions of the cover can engage into the openings. When the portions of the cover are corners, the openings preferably are also arranged in corner regions of the holder. In this embodiment, the edge regions of the cover extend in the vicinity of the transition from the mounting portion to the holding portion of the holder. Due to this configuration, the component can be of comparatively compact and lightweight design. In said regions, the openings can also be incorporated into the holder easily and at low cost.

In an alternative configuration, the holder and the cover comprise materials with a different thermal expansion behavior. Thus, the material to be used for the cover is that material which is best suited for the tasks assigned to the cover. The thermal expansion behavior can be ignored here. The same applies for the holder. Thus, in general the most suitable material can be used both for the holder and for the cover, which ensures a high quality and functionality of the component of the exhaust system. As explained already, a different thermal expansion behavior can be compensated by the provided clearance.

The holder can comprise a ferritic steel alloy and/or the cover can comprise an alloy resistant to hot-gas corrosion and wet corrosion, in particular an austenitic or ferritic steel alloy, and/or the wall can comprise a ferritic steel alloy. These materials are particularly well suited for the respectively associated components.

An exhaust system for an internal combustion engine is also provided that comprises a component of the disclosure. In particular due to the quick and easy manufacturability of the component according to the disclosure, the exhaust system in general can also be manufactured comparatively quickly and easily. Hence, the exhaust system is also relatively inexpensive.

Furthermore, a method as mentioned above is disclosed, which comprises the following steps:

a. mounting a perforated cover on a holder by introducing at least one portion of the cover into an opening provided on the holder, and subsequently
b. attaching the assembly comprising the cover and the holder to a wall so that the cover at least partly closes an opening provided in the wall.

Introducing the portions of the cover into the openings at the holder can be effected quickly and easily. Preferably, no tool is required for this purpose. It is also conceivable to use a mounting device, and by using the same, mount the cover on the holder manually, semi-automatically, or fully automatically. The cover and the holder then form a coherent assembly, which facilitates their handling and positioning on the wall. In particular, the assembly thus can be precisely attached to the wall. In general, the method hence can proceed quickly and can be performed with little expenditure.

In connection with step b), the frame can be welded or soldered to the cover on the wall.

During step a), the cover can assume a bending state for introducing the at least one portion into the associated opening, and in a subsequently assumed relaxation state can be exclusively positively mounted on the holder. In the bending state, the cover hence is subjected to a certain load so that bending of the cover is effected. In the relaxation state, the cover is planar as compared with the bending state, wherein it is not excluded that the cover has a certain bend also in the relaxation state, which bend, for example, corresponds to a contour of the holder or the wall. The bend assumed in the relaxation state is distinctly smaller, however, as compared with the bend present in the bending state. In this way, the cover can be mounted on the holder easily and reliably. Thus, slipping of the portions of the cover out of a respectively associated opening can geometrically be made impossible.

Alternatively or additionally, during step a) two opposite corners of the cover can each be introduced into an associated opening. The cover hence is bent such that both opposite corners can be introduced into respectively associated openings. Then, the cover is again transferred into the relaxation state. Thus, the cover is positively held on the holder.

BRIEF DESCRIPTION OF THE DRAWINGS

The disclosure will be explained below with reference to various exemplary embodiments that are shown in the attached drawings, in which.

DETAILED DESCRIPTION

Figure 1:
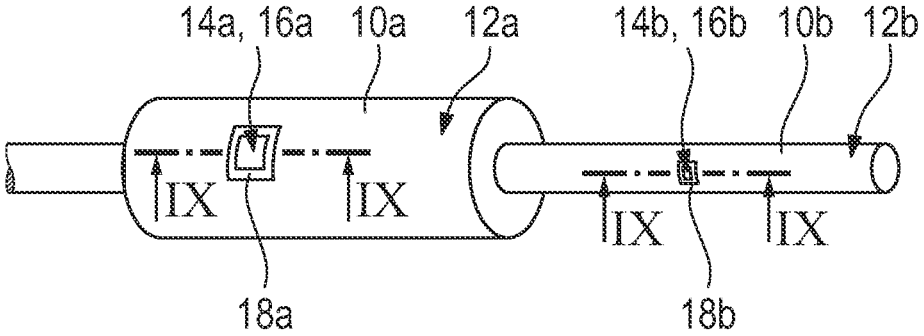
FIG. 1 schematically shows a part of an exhaust system comprising two components according to the disclosure, which have been manufactured using a method according to the disclosure, FIG. 2 in a detail view shows an assembly of one of the components of FIG. 1 comprising a cover and a frame in a perspective view.
Figure 2:
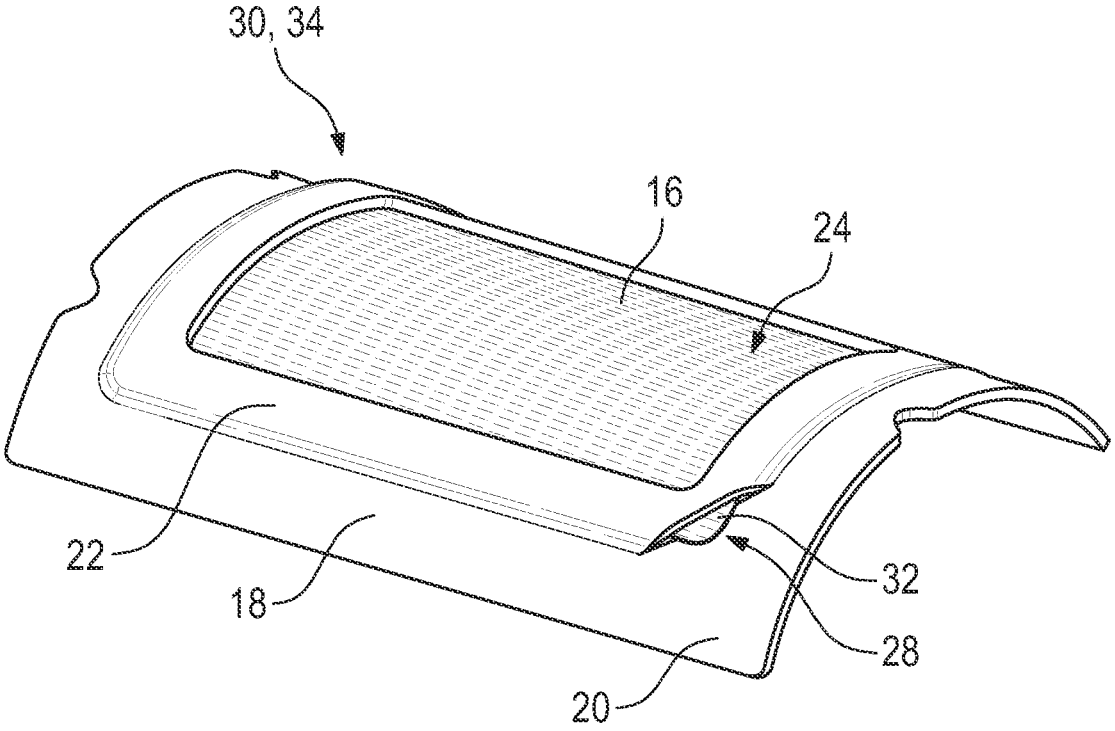
Figure 3:
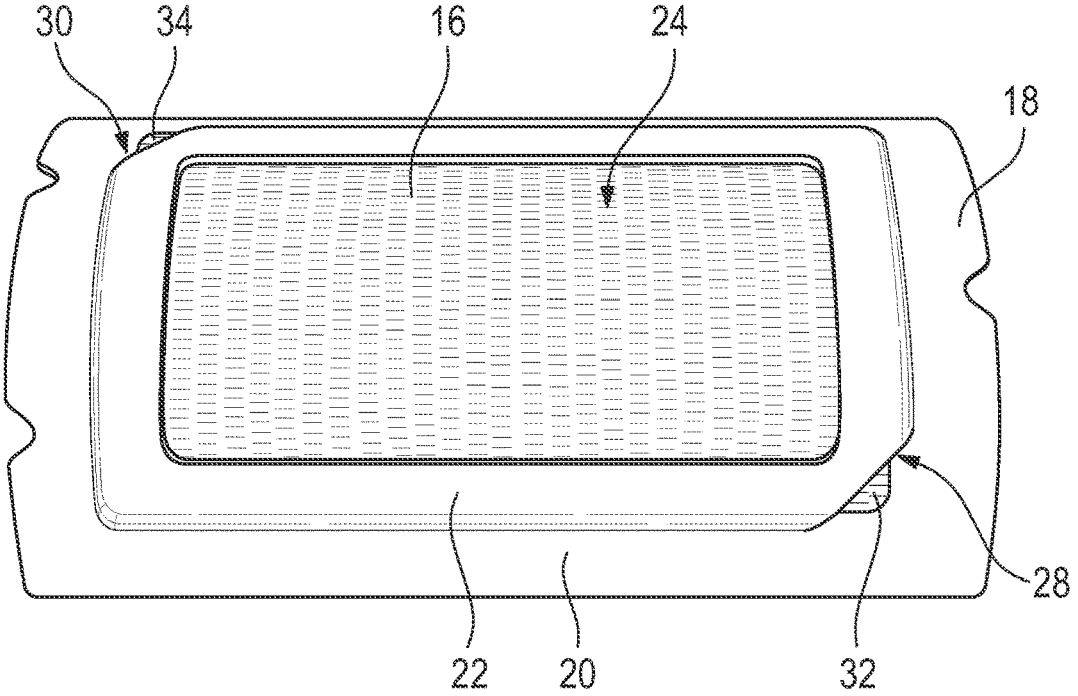
FIG. 3 shows the assembly of FIG. 2 in a view from above.
Figure 4:
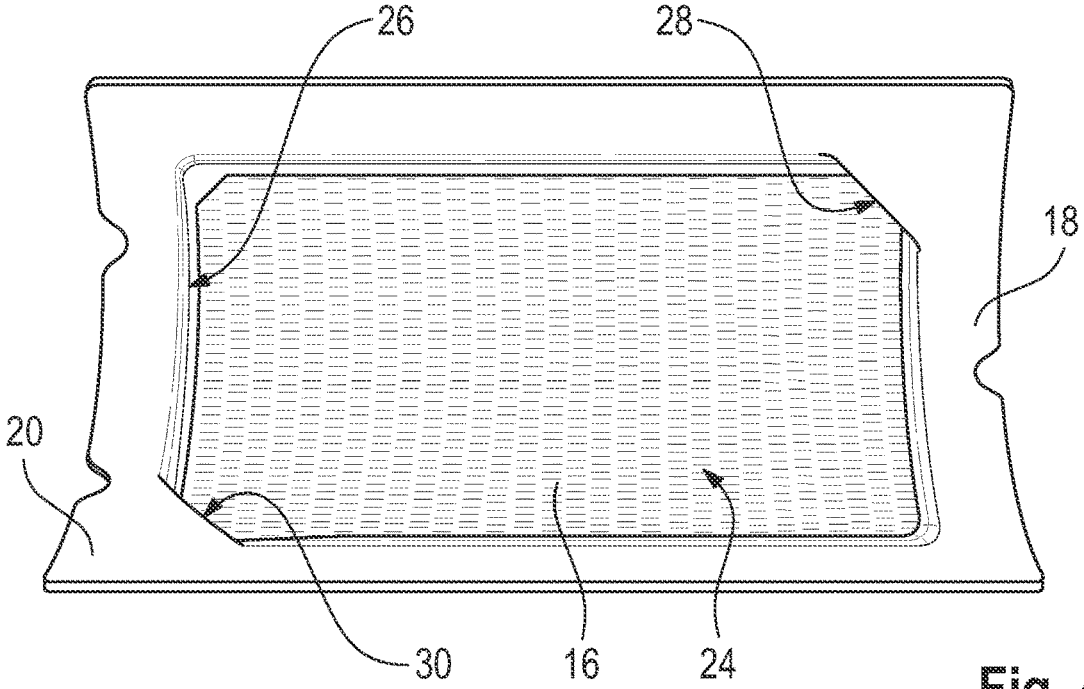
FIG. 4 shows the assembly of FIG. 2 in a bottom view.
Figure 5:
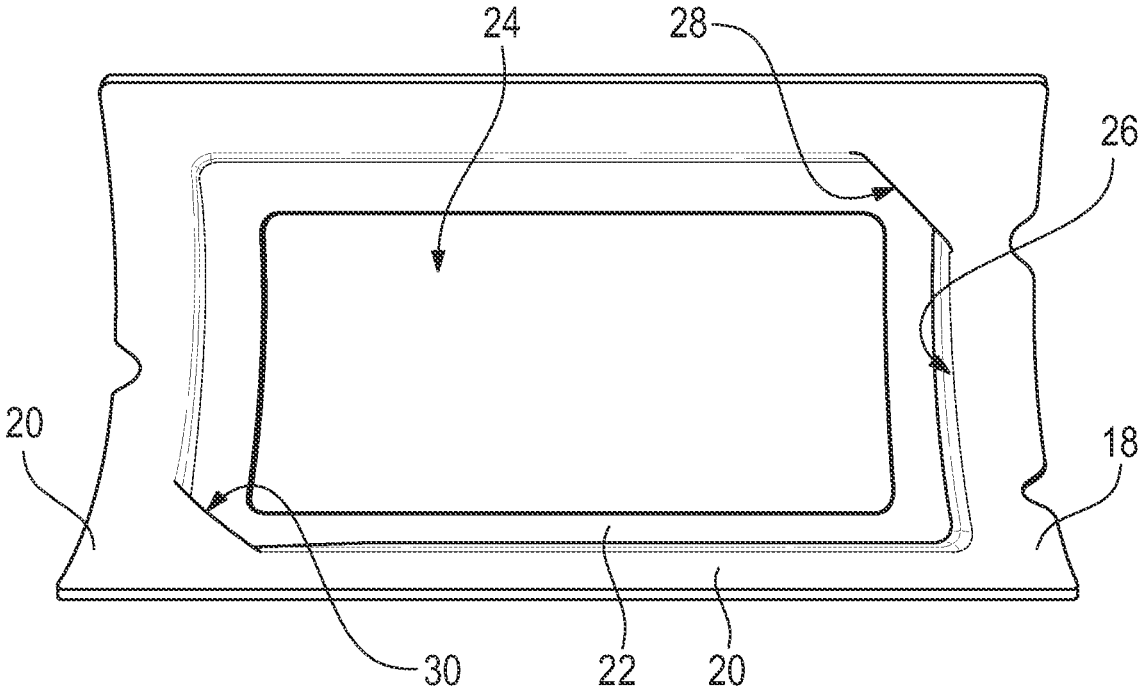
FIG. 5 shows the frame of the assembly of FIG. 2 in a view corresponding to FIG. 4.

FIG. 1 shows two components 10*a*, 10*b* of an exhaust system. The component 10*a* is a housing, and the component 10*b* is an exhaust pipe that for example serves to conduct exhaust gas of an internal combustion engine towards an environment.

In the component 10*a* configured as a housing, there can be arranged components with which the exhaust gas is treated, for example a catalyst substrate or a particle filter. Alternatively, this can also be the housing of a muffler.

As far as the components 10*a*, 10*b* are arranged at a certain distance from the outlet valves of the internal combustion engine and the temperature of the exhaust gas therefore already has decreased to some extent, a ferritic steel alloy can be used as material for the components 10*a*, 10*b*, in particular for their walls 12*a*, 12*b*.

The walls 12*a*, 12*b* of the components 10*a*, 10*b* each are provided with an opening 14*a*, 14*b*. The same can be circular, rectangular, polygonal or oval, for example, and can have a surface area of a few square centimeters.

In the embodiments of FIG. 1, the openings 14*a*, 14*b* each are completely closed with a perforated cover 16*a*, 16*b*.

The perforated covers 16*a*, 16*b* each comprise a metal foil or a metal sheet whose wall thickness can be for example 0.3 mm They are provided with a plurality of small perforations, wherein the proportion of perforations in the entire surface of the cover 16*a*, 16*b* lies in the range of 1% to 10%, and preferably of 4% to 8%. A degree of perforation of 6% is particularly preferred.

The perforations can have a circular shape, a rectangular shape or another geometry. When their open surface is converted into a circular shape, it has a perforation diameter in the order of 0.1 mm to 1.5 mm.

When the dimensions of the openings are smaller than these values, reference is also made to a microperforated cover 16*a*, 16*b*.

As material for the covers 16*a*, 16*b*, there is used an alloy that is resistant to hot-gas corrosion and wet corrosion, such as Inconel. Preferably, an austenitic steel alloy or a suitable ferritic alloy can be used.

The wall thickness of the cover 16*a*, 16*b* lies below 1 mm and in particular in the order of 0.3 mm.

These values apply for the initial sheet. With regard to cutting or shaping manufacturing methods, as they can be used for manufacturing the cover, the cover possibly is "thicker" after machining, in case the distance of the surface tips is measured, as burrs may be obtained.

The perforated covers 16*a*, 16*b* each are attached to the associated wall 12*a*, 12*b* with an associated holder 18*a*, 18*b*.

The same is configured as a frame and is made of sheet metal. Preferably, the material used is a ferritic steel alloy, in particular a steel alloy with the same thermal expansion behavior as the associated component 10*a*, 10*b*, more exactly the associated wall 12*a*, 12*b*.

For the following detailed description of the components 10*a*, 10*b* no more distinction is made between the two embodiments shown in FIG. 1. Therefore, the reference numerals partly are also used without the suffixes "a" and "b". The explanations equally apply for the components 10*a* and 10*b*.

The holder 18 includes a circumferential mounting portion 20 that is provided to be attached to the associated wall 12*a*, 12*b*. Within the circumferential mounting portion 20 a holding portion 22 is provided. The same forms the inner edge of the holder 18 and defines a cutout 24 that has a similar size as the respectively associated opening 14*a*, 14*b*. The cutout hence can be slightly larger than the respectively associated opening 14*a*, 14*b*, slightly smaller or substantially the same size.

Figure 10:
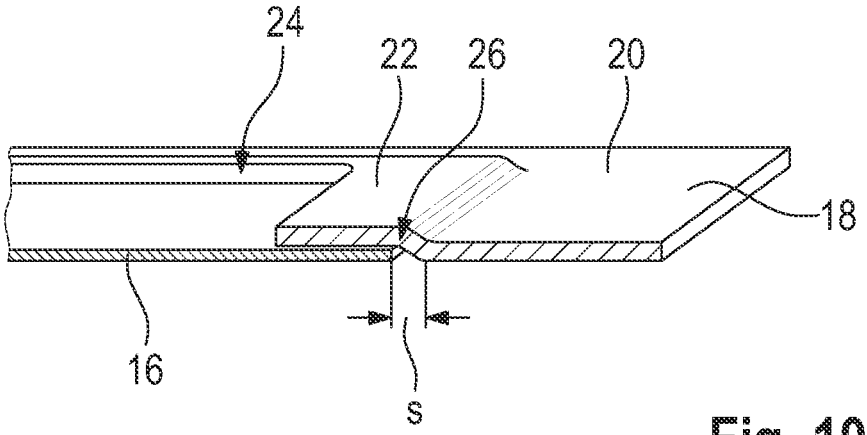
FIG. 10 shows an enlarged detail X of FIG. 10, wherein the wall is omitted, FIG. 11 in a top view shows an assembly of one of the components of FIG. 1 comprising a cover and a frame according to another embodiment.

As can be seen in particular in FIG. 10, the holding portion 22 is offset with respect to the mounting portion 20 in a direction perpendicular to the mounting portion 20 and hence also perpendicular to the wall 12*a*, 12*b*. The offset nominally at least amounts to the thickness of the perforated cover 16. It may occur that the offset within the range of the permitted tolerances also is smaller than the thickness of the perforated cover 16. However, this does not preclude the intended function of the component 10*a*, 10*b*.

The offset between the holding portion 22 and the mounting portion 20 can be achieved by suitably embossing and/or stamping a flat sheet metal blank of the holder 18.

The holding portion 22 in addition defines a receptacle for the cover 16 that can be arranged in this receptacle. The dimensions of the cover 16 are chosen such that the same is slightly smaller than the receptacle. Expressed in other words, a minor clearance "s" remains between the end faces of the cover 16 and a step 26 that is formed at the transition between the holding portion 22 and the mounting portion 20. This clearance "s" lies in the range of 0.2 to 4 mm.

When the holder 18 is mounted on the associated component 10*a*, 10*b*, the perforated cover 16 below the holding portion 22 can "travel" parallel to the wall of the component 10*a*, 10*b* due to the clearance "s", namely until it each abuts against the step 26 that acts as an abutment surface on the holder 18 for the cover 16.

In addition, two mutually opposite openings 28, 30 each are provided on the holder 18 of the embodiment of FIGS. 2 to 5.

An associated portion 32, 34 of the cover 16 engages into each of the openings 28, 30.

In the embodiment of FIGS. 2 to 5, the cover 16 correspondingly includes two portions 32, 34 which are arranged on opposite sides of the cover 16.

The portions 32, 34 are corners of the cover 16.

Correspondingly, the associated openings 28, 30 are arranged in corner regions of the holder 18. Furthermore, the openings 28, 30 are located at the transition from the mounting portion 20 to the holding portion 22.

Figure 6:
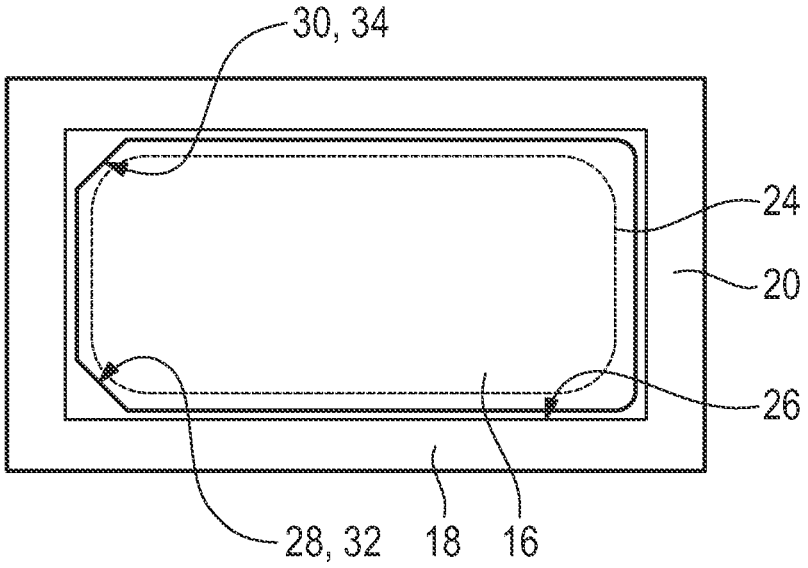
FIG. 6 shows an alternative to the assembly of FIG. 2 in a schematic bottom view corresponding to FIG. 4.
Figure 7:
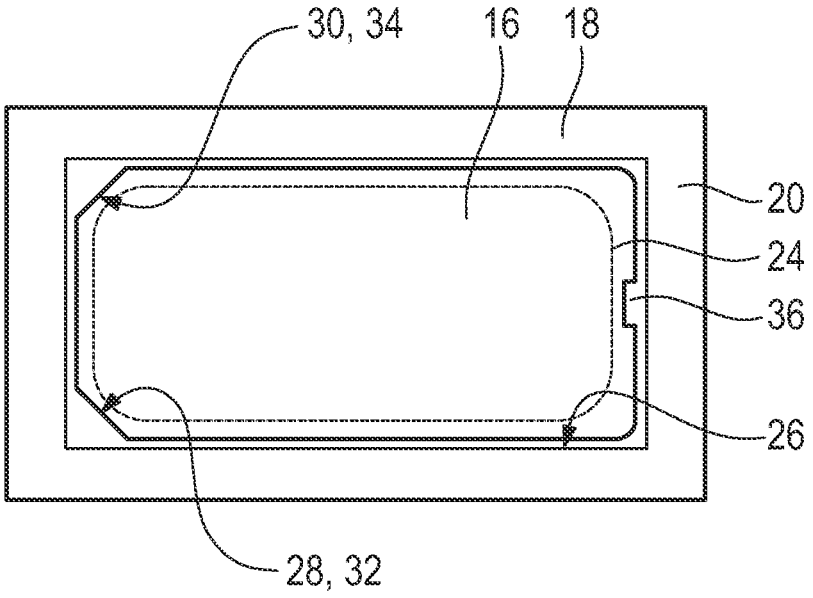
FIG. 7 shows another alternative of the assembly of FIG. 2 in a schematic bottom view corresponding to FIG. 4.
Figure 8:
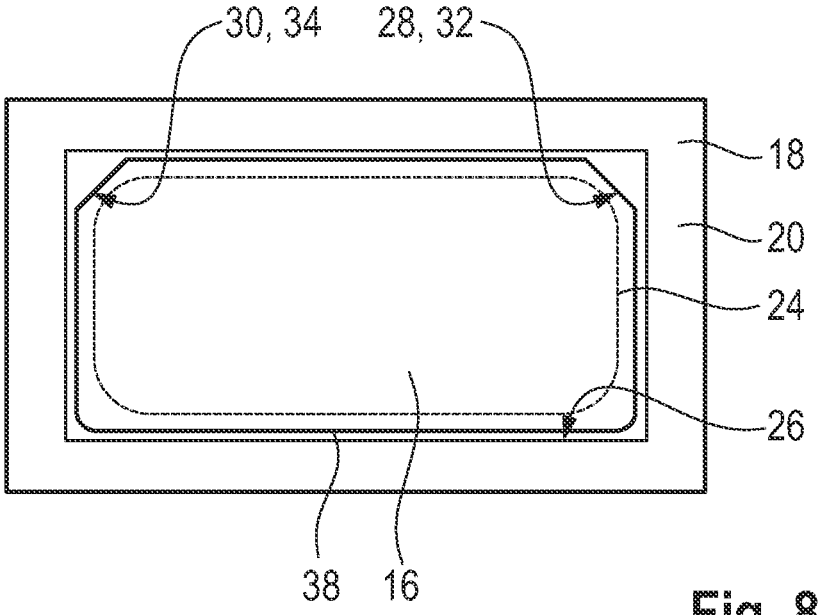
FIG. 8 shows an additional alternative to the assembly of FIG. 2 in a schematic bottom view corresponding to FIG. 4.

In the embodiments of FIGS. 6 to 8, in contrast to the embodiment of FIGS. 2 to 5, the portions 32, 34 of the cover 16 are designed as adjacent corners. This results in a corresponding position of the openings 28, 30.

In the embodiment of FIGS. 6 and 7, the portions 32, 34 are adjacent along a short edge of the rectangular cover 26.

In the embodiment of FIG. 7, the holder 18 additionally includes a bearing portion 36 that engages behind the cover 16 in a direction perpendicular to the wall 12*a*, 12*b*.

In the illustrated embodiment, the bearing portion 36 is configured as a substantially rectangular tab and is arranged on an inside of the holder 18. It extends substantially in the same plane as the mounting portion 20. The cover 16 hence is arranged in the region of the bearing portion 36 between the same and the holding portion 22.

In the embodiment of FIG. 8, the portions 32, 34 are adjacent along the long edge of the rectangular cover 16.

The cover 16 and the holder 18 can be dimensioned such that the cover 16 in a substantially flat state of the assembly comprising the cover 16 and the holder 18 rests against the holder with its edge 38 shown at the bottom in FIG. 8. In particular, the edge 38 rests against the holder 18 under a certain tension.

Only when the assembly comprising the holder 18 and the cover 16 is slightly bent while being mounted on the wall 12*a*, 12*b*, a certain clearance is obtained between the holder 18 and the cover 16 in the vertical direction in FIG. 8.

Figure 11:
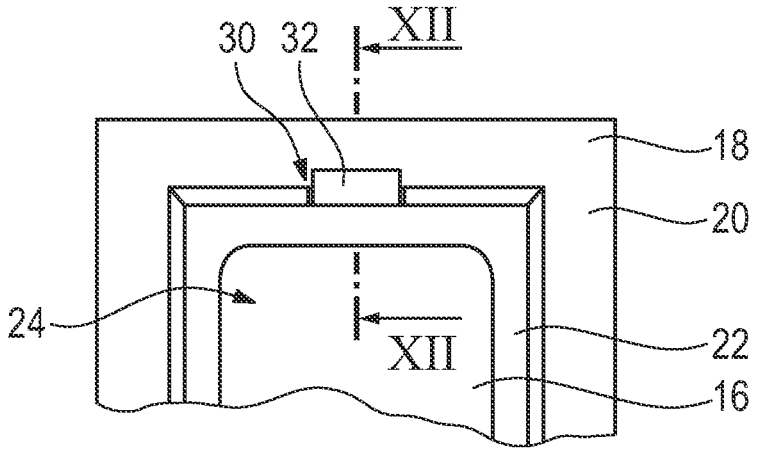
Figure 12:
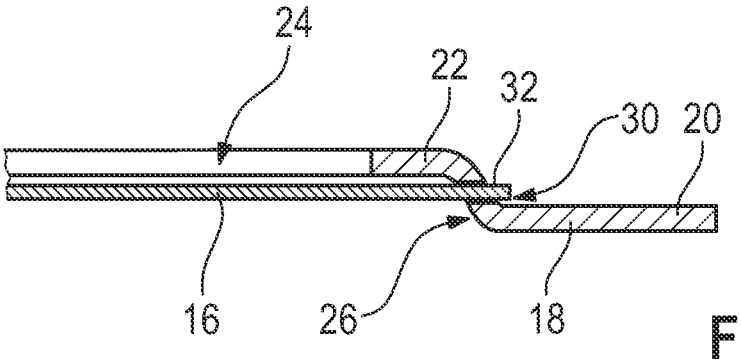
FIG. 12 shows a sectional view corresponding to a section XII-XII of FIG. 12.

In the embodiment of FIGS. 11 and 12, which differs from the aforementioned embodiments merely by the design of the portions 32, 34 and the associated openings 28, 30, the portions 32, 34 are formed by tabs of the cover 16. The figures merely show the portion 32.

In all embodiments, the cover 16 is positively and non-cohesively coupled with the holder 18 via the portions 32, 34. The cover 16 and the holder 18 thus form an assembly and can jointly be attached to the associated wall 12*a*, 12*b*.

The coupling between the cover 16 and the holder 18 is designed such that the cover 16 is mounted on the holder 18 substantially without clearance in a direction perpendicular to the wall 12. As explained already, the coupling in directions transverse thereto is subject to a certain clearance.

The holder 18 is firmly mounted on the associated wall 12*a*, 12*b* with its mounting portion 20. In the illustrated exemplary embodiment, the mounting portion is welded to the wall 12*a*, 12*b*.

The manufacture of the components 10*a*, 10*b* proceeds as follows.

Figure 9:
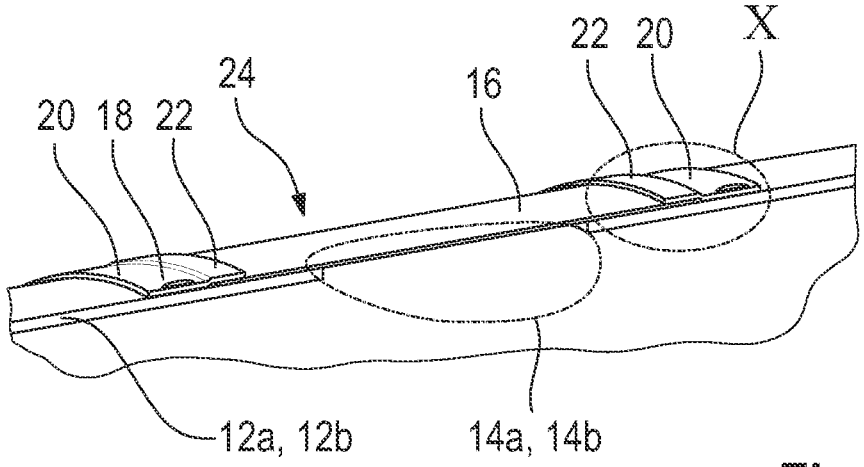
FIG. 9 shows a sectional view corresponding to the sections IX-IX of FIG. 1.

First, the cover 16 is mounted on the associated holder 18 by introducing at least one of the portions 32, 34 of the cover 16 into the associated opening 28, 30. Hence, in the embodiments of FIGS. 2 to 7 the corners of the cover 16 are introduced into the openings 28, 30, and in the embodiments of FIGS. 8 and 9 the portion 32 configured as a tab is introduced into the opening 30.

To introduce the portions 32, 34 into the associated openings 28, 30, the cover 16 can be transferred into a bending state by applying a corresponding force on the cover 16. This can be done by hand.

The portions 32, 34 then are each positioned at the entrance of the associated opening 28, 30. The cover 16 then is relieved with regard to the force so that the same passes into a relaxation state in which the cover 16 is flat or planar as compared to the bending state. In the process, the portions 32, 34 are introduced into the openings 28, 30. As mentioned already, it is merely important that the cover 16 is flat or planar as compared to the bending state. It is very well possible that in this state the cover 16 still has a certain bend which for example corresponds to the contour of the holder 18 or the wall 12*a*, 12*b*.

Thus, the cover 16 is positively mounted on the holder 18, and the cover 16 and the holder 18 form an assembly.

Subsequently, this assembly is arranged on an associated wall 12*a*, 12*b* in such a way that it closes the opening 14.

Although various embodiments have been disclosed, a worker of ordinary skill in this art would recognize that certain modifications would come within the scope of this disclosure. For that reason, the following claims should be studied to determine the true scope and content of this disclosure.

The invention claimed is:

1. A component of an exhaust system for an internal combustion engine, comprising:

a wall in which at least one opening is provided;

a perforated cover which at least partly closes the at least one opening; and a holder to mount the perforated cover on the wall of the component, and wherein a portion of the perforated cover engages into an opening provided on the holder, wherein at least two portions of the perforated cover each engage into separate openings on the holder.

2. The component according to claim 1, wherein at least one of the two portions of the perforated cover, which engages into an associated opening of the separate openings, is a corner of the perforated cover or a tab of the perforated cover.

3. The component according to claim 2, wherein all portions of the perforated cover, which engage into associated openings, are corners of the perforated cover or tabs of the perforated cover.

4. The component according to claim 1, wherein the holder includes a bearing portion which engages behind the perforated cover in a direction perpendicular to the wall.

5. The component according to claim 1, wherein the holder and the perforated cover are non-cohesively or exclusively positively coupled with each other.

6. The component according to claim 1, wherein the holder is a frame that is mounted on the wall and surrounds an outer edge of the perforated cover.

7. The component according to claim 1, wherein, in a direction perpendicular to the wall, the perforated cover is mounted on the holder substantially without clearance.

8. The component according to claim 1, wherein a clearance is provided between the holder and the perforated cover so that the perforated cover is shiftable parallel to the wall of the component.

9. The component according to claim 8, wherein the clearance is formed between an end face of the perforated cover and an abutment surface of the holder opposing the end face at a distance.

10. The component according to claim 9, wherein the holder includes a mounting portion that is mounted on the wall, and a holding portion for the perforated cover that is offset with respect to the mounting portion as seen in a direction perpendicular to the wall, and that the abutment surface is formed by a step at a transition from the mounting portion to the holding portion.

11. The component according to claim 10, wherein an opening or openings that engage portions of the perforated cover is/are provided at the transition from the mounting portion to the holding portion, and wherein the opening or the openings is/are arranged in a corner region of the holder.

12. The component according to claim 1, wherein the at least two portions are arranged on substantially opposite sides of the perforated cover.

13. The component according to claim 1, wherein at least one of the two portions of the perforated cover, which engages into an associated opening of the separate openings, is a corner of the perforated cover and a tab of the perforated cover.

14. The component according to claim 1, wherein the holder and the perforated cover are non-cohesively and exclusively positively coupled with each other.

15. The component according to claim 1, wherein the at least two portions of the perforated cover include perforations.

16. A method for manufacturing a component of an exhaust system for an internal combustion engine, comprising the following steps:

a) mounting a perforated cover on a holder by introducing at least one portion of the perforated cover into an opening provided on the holder, and subsequently b) attaching an assembly comprising the perforated cover and the holder on a wall so that the perforated cover at least partly closes an opening provided in the wall, wherein, during step a), two opposite corners of the perforated cover are each introduced into an associated opening.

17. The method according to claim 16, wherein, during step a), the perforated cover assumes a bending state for introducing the at least one portion into an associated opening, and in a subsequently assumed relaxation state the perforated cover is exclusively positively mounted on the holder.

18. A method for manufacturing a component of an exhaust system for an internal combustion engine, comprising the following steps:

a) mounting a perforated cover on a holder by introducing at least one portion of the perforated cover into an opening provided on the holder, including inserting a first perforated portion of the perforated cover into a first opening provided on the holder, and inserting a second perforated portion of the perforated cover into a second opening provided on the holder that is separate from the first opening, and subsequently b) attaching an assembly comprising the perforated cover and the holder on a wall so that the perforated cover at least partly closes an opening provided in the wall.

* * * * *